US009398653B2

(12) United States Patent
Kuang et al.

(10) Patent No.: US 9,398,653 B2
(45) Date of Patent: Jul. 19, 2016

(54) LED DRIVER, THE CONTROL CIRCUIT AND THE LED DRIVING METHOD

(71) Applicant: Chengdu Monolithic Power Systems Co., Ltd., Chengdu (CN)

(72) Inventors: Naixing Kuang, Hangzhou (CN); Zilin Fan, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 0 days.

(21) Appl. No.: 14/866,737

(22) Filed: Sep. 25, 2015

(65) Prior Publication Data

US 2016/0095178 A1 Mar. 31, 2016

(30) Foreign Application Priority Data

Sep. 30, 2014 (CN) ..... 2014 1 0520968

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0818* (2013.01); *H05B 33/0845* (2013.01)

(58) Field of Classification Search
None
See application file for complete search history.

(56) References Cited

U.S. PATENT DOCUMENTS

| | | | | |
|---|---|---|---|---|
| 8,581,518 | B2 | 11/2013 | Kuang et al. | |
| 8,598,802 | B2 | 12/2013 | Huang et al. | |
| 8,901,851 | B2 | 12/2014 | Kuang et al. | |
| 2010/0165683 | A1* | 7/2010 | Sugawara | |
| 2013/0301311 | A1* | 11/2013 | Wang | H02M 3/33515 363/21.13 |
| 2015/0366018 | A1 | 12/2015 | Kuang et al. | |
| 2015/0366019 | A1 | 12/2015 | Kuang et al. | |

* cited by examiner

*Primary Examiner* — Anh Tran
(74) *Attorney, Agent, or Firm* — Perkins Coie LLP

(57) ABSTRACT

The present invention discloses a LED driver including a power stage, an inductor, an error amplifier, a set comparator, a first timer, a logical AND circuit, a reset comparator, a second timer a logical OR circuit, a RS flip flop and a driving circuit. The LED driver provides sufficient latching current for the TRIAC dimmer with no large RC circuit, so as to optimize the dimming and reduce system size.

15 Claims, 5 Drawing Sheets

LED DRIVER, THE CONTROL CIRCUIT AND THE LED DRIVING METHOD

CROSS-REFERENCE TO RELATED APPLICATION(S)

This application claims priority to and the benefit of Chinese Patent Application No. 201410520968.7, filed Sep. 30, 2014, which is incorporated herein by reference in its entirety.

TECHNICAL FIELD

The present invention relates to electronic circuits, more specifically, the present invention relates to LED (light emitting diode) drivers, the control circuit and the LED driving method.

BACKGROUND

In LED applications, TRIAC dimmers are popularly used. Conventionally, the LED system works at boundary conduction mode (BCM). Two approaches are used to shape the input current of the LED driver for the optimization for the TRIAC dimmer's latching current requirement under BCM mode. The first one is to add a big RC circuit to supply the latching current for the dimmer. However, this method increases the power loss. The second one is to shape the input current by increasing the peak current of power device to supply for sufficient latching current. However, this method brings higher stress of the power components, and increases the circuit size and the cost.

SUMMARY

A LED driver provides relatively high average inductor current at the initial stage of each delivery cycle of the input AC voltage, so that sufficient latching current of the TRIAC dimmer is provided and no large RC circuit is needed.

The use of the similar reference label in different drawings indicates the same of like components.

DETAILED DESCRIPTION

Embodiments of circuits for LED driver are described in detail herein. In the following description, some specific details, such as example circuits for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with circuits and methods that are meant to be exemplary and illustrative. In various embodiments, the above problem has been reduced or eliminated, while other embodiments are directed to other improvements.

Figure 1:
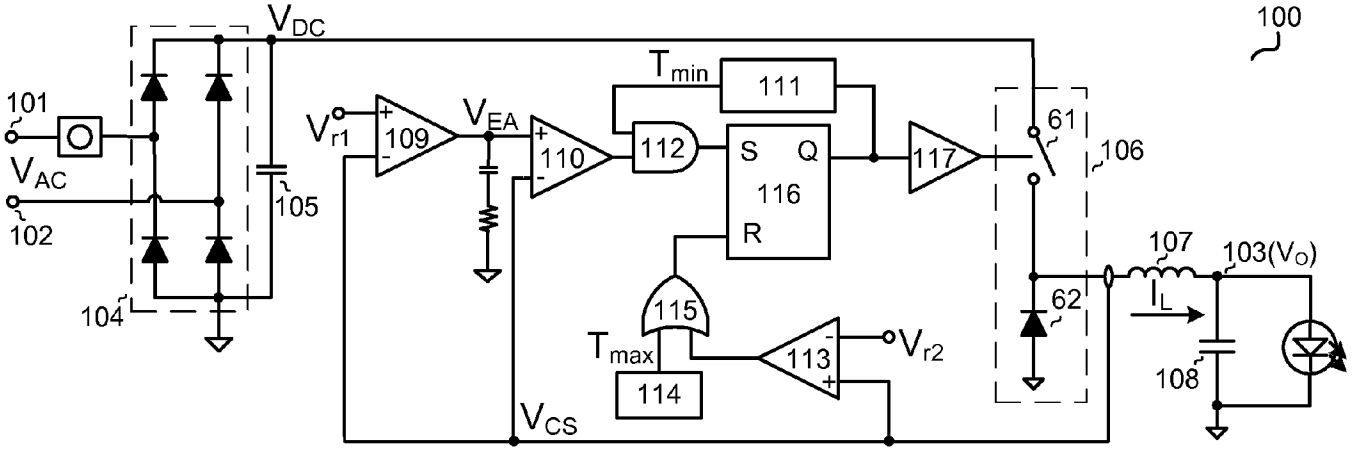
FIG. 1 schematically shows a LED driver 100 in accordance with an embodiment of the present invention.

FIG. 1 schematically shows a LED driver 100 in accordance with an embodiment of the present invention. In the example of FIG. 1, the LED driver 100 comprises: a first input port 101 and a second input port 102, configured to receive an input AC voltage $V_{AC}$; an output port 103, configured to provide a driving voltage $V_O$ for the LED; a rectifier 104, coupled to the first input port 101 and the second input port 102, to receive the input AC voltage $V_{AC}$ to provide a rectified voltage $V_{DC}$; an input capacitor 105, coupled to the rectifier 104 to receive the rectified voltage $V_{DC}$; a power stage 106, having a main power switch 61 and a freewheel power switch 62; an inductor 107, coupled between the power stage 106 and the output port 103, wherein the inductor 107 gains energy from the input AC voltage $V_{AC}$ and delivers the energy to the output port 103 when the main power switch 61 is ON and when the freewheel power switch 62 is OFF, and the inductor 107 supplies energy to the output port 103 via the freewheel power switch 62 when the main power switch 61 is OFF; an output capacitor 108, coupled between the output port 103 and a reference ground; an error amplifier 109, having a first input terminal, a second input terminal and an output terminal, wherein the first input terminal is configured to receive a first reference voltage $V_{r1}$, the second input terminal is configured to receive a current sense signal $V_{CS}$ indicative of a current flowing through the inductor 107, and wherein the error amplifier 109 generates an error amplified signal $V_{EA}$ at the output terminal by amplifying and integrating a difference between the first reference voltage $V_{r1}$ and the current sense signal $V_{CS}$; a set comparator 110, having a first input terminal, a second input terminal and an output terminal, wherein the first input terminal is coupled to the error amplifier 109 to receive the error amplified signal $V_{EA}$, the second input terminal is configured to receive the current sense signal $V_{CS}$, and wherein based on the error amplified signal $V_{EA}$ and the current sense signal $V_{CS}$, the set comparator 110 generates a set comparison signal at the output terminal; a first timer 111, configured to generate a minimum OFF time signal $T_{min}$; a logical AND circuit 112, having a first input terminal, a second input terminal and an output terminal, wherein the first input terminal is coupled to the set comparator 110 to receive the set comparison signal, the second input terminal is coupled to the first timer 111 to receive the minimum OFF time signal $T_{min}$, and wherein based on the set comparison signal and the minimum OFF time signal, the first logical AND circuit 112 generates a set signal at the output terminal; a reset comparator 113, having a first input terminal, a second input terminal and an output terminal, wherein the first input terminal is configured to receive a second reference voltage $V_{r2}$, the second input terminal is configured to receive the current sense signal $V_{CS}$, wherein based on the second reference voltage $V_{r2}$ and the current sense signal $V_{CS}$, the reset comparator 113 generates a reset comparison signal at the output terminal; a second timer 114, configured to generate a maximum ON time signal $T_{max}$; a logical OR circuit 115, having a first input terminal, a second input terminal and an output terminal, wherein the first input terminal is coupled to the reset comparator 113 to receive the reset comparison signal, the second input terminal is coupled to the second timer 114 to receive the maximum ON time signal $T_{max}$, wherein based on the reset comparison signal and the maximum ON time signal $T_{max}$, the logical OR circuit 115 generates a reset signal at the output terminal; a RS flip flop 116, having a set input terminal S, a reset input terminal R and an output terminal Q, wherein the set input terminal S is coupled to the logical AND circuit 112 to receive the set signal, the reset input terminal R is coupled to the logical OR circuit 115 to receive the reset signal, wherein based on the set signal and the reset signal, the RS flip flop 116 generates a control signal at the output terminal Q; and a driving circuit 117, coupled to the RS flip flop 116 to receive the control signal to generate a driving signal, to control the operation of the main power switch 61.

In one embodiment, the LED driver 100 further comprises a TRIAC dimmer, coupled between the first input port 101 and the rectifier 104.

In one embodiment, the second reference voltage $V_{r2}$ has a voltage level higher than twice of the first reference voltage $V_{r1}$, i.e., $V_{r2}>2\times V_{r1}$.

In one embodiment, the first timer 111 starts to time in response to a falling edge of the control signal, to generate the minimum OFF time signal $T_{min}$.

Figure 2:
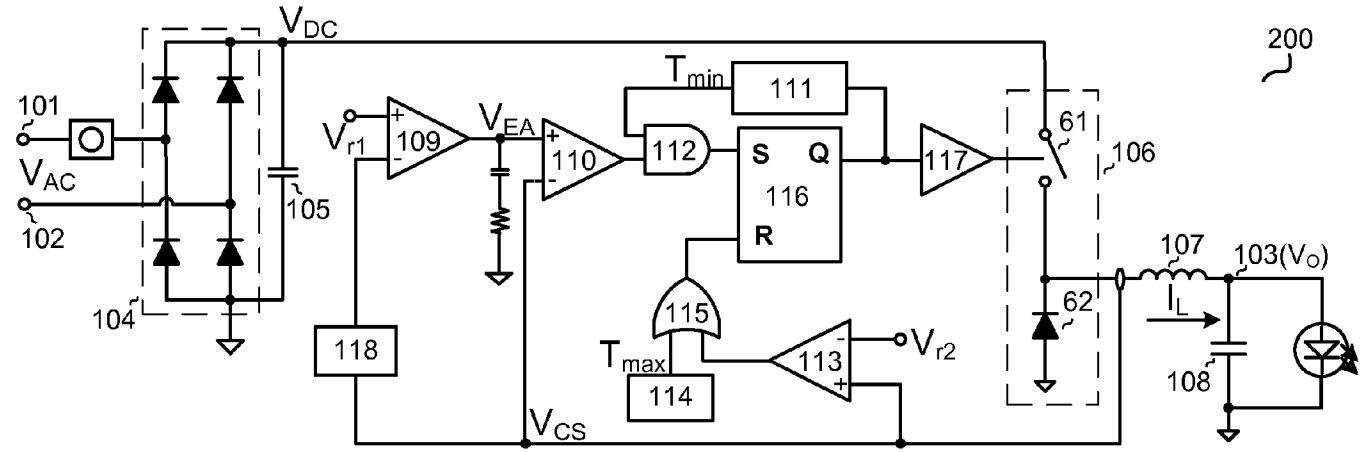
FIG. 2 schematically shows a LED driver 200 in accordance with an embodiment of the present invention.

FIG. 2 schematically shows a LED driver 200 in accordance with an embodiment of the present invention. The LED driver 200 in FIG. 2 is similar with the LED driver 100 in FIG. 1, with a difference that the LED driver 200 in FIG. 2 further comprises: an average circuit 118, configured to receive the current sense signal $V_{CS}$ to generate an average signal to the second input terminal of the error amplifier 109. The other circuit configuration of the LED driver 200 in FIG. 2 is similar to the LED driver 100 in FIG. 1, which will not be illustrated for brevity.

Figure 3:
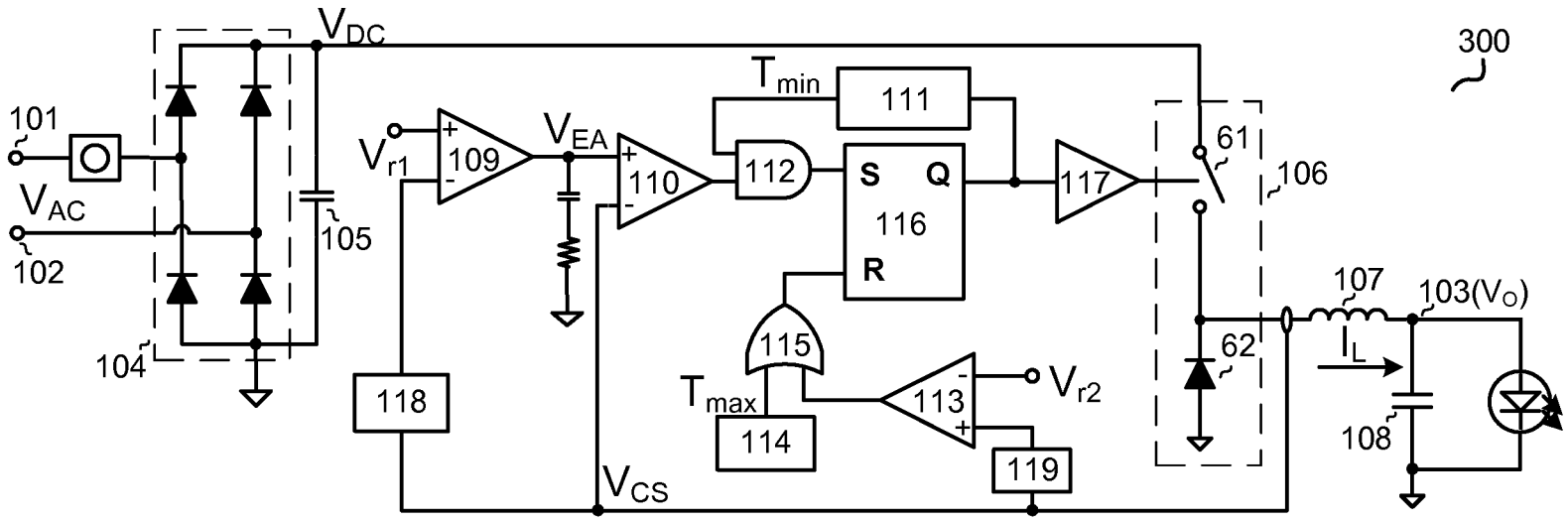
FIG. 3 schematically shows a LED driver 300 in accordance with an embodiment of the present invention.

FIG. 3 schematically shows a LED driver 300 in accordance with an embodiment of the present invention. The LED driver 300 in FIG. 3 is similar with the LED driver 200 in FIG. 2, with a difference that the LED driver 300 in FIG. 3 further comprises: a leading edge blanking (LEB) circuit 119, configured to receive and to blank the current sense signal $V_{CS}$, and to deliver the blanked current sense signal to the second input terminal of the reset comparator 113. The other circuit configuration of the LED driver 300 in FIG. 3 is similar to the LED driver 200 in FIG. 2, which will not be illustrated for brevity.

In one embodiment, the LEB circuit 119 eliminates the error caused by the reverse recovery of the body diode and the parasitic oscillation. However, one skilled in the art should realize that the LED driver may have no LEB circuit in other embodiments.

The operation principle of the LED driver 100, 200 and/or 300 will be illustrated hereinafter with combination of FIG. 4.

1) Time interval of $T_0$-$T_1$: at time point $T_0$, the input AC voltage $V_{AC}$ and/or the rectified voltage $V_{DC}$ starts to be higher than the driving voltage $V_O$, so the power stage 106 and the inductor 107 starts to work. The inductor current $I_L$ is low and its peak value (i.e., the peak inductor current) starts to increase. At the error amplifier 109, the inductor current $I_L$ is zero before time point $T_0$, i.e., the difference between the first reference voltage $V_{r1}$ and the current sense signal $V_{CS}$ is big, so the error amplified signal $V_{EA}$ is at a saturated state. Accordingly, the error amplified signal $V_{EA}$ keeps the saturated state before time point $T_1$ because the first reference voltage $V_{r1}$ keeps to be higher than the current sense signal $V_{CS}$, and the set comparison signal keeps high because the error amplified signal $V_{EA}$ keeps to be higher than the current sense signal $V_{CS}$ at the set comparator 110. As a result, the set input terminal S of the RS flip flop 116 is determined by the minimum OFF time signal $T_{min}$. At the reset comparator 113, the peak value of the current sense signal $V_{CS}$ (i.e., the peak current sense signal) is lower than the second reference voltage $V_{r2}$ because of the low inductor current $I_L$, causing the reset comparison signal to be logical low. Thus the reset input terminal R of the RS flip flop 116 is determined by the maximum ON time signal $T_{max}$. Accordingly, the LED driver operates at the mode of minimum OFF time and maximum ON time.

2) Time interval of $T_1$-$T_2$: The peak inductor current increases with the increase of the input AC voltage $V_{AC}$. At time point $T_1$, the current sense signal $V_{CS}$ reaches the second reference voltage $V_{r2}$ due to the increase of the peak inductor current. Accordingly, at the reset comparator 113, the current sense signal $V_{CS}$ reaches the second reference voltage $V_{r2}$ in every switching cycle. As a result, the reset input terminal R of the RS flip flop 116 is determined by the reset comparison signal. At the error amplifier 109, the average value of the current sense signal $V_{CS}$ (i.e., the average current sense signal) is higher than the first reference voltage $V_{r1}$, so the error amplified signal $V_{EA}$ starts to decrease. However, the error amplified signal $V_{EA}$ is still higher than the peak current sense signal. So the set input terminal S of the RS flip flop 116 is still determined by the minimum OFF time signal $T_{min}$. Accordingly, the LED driver operates at the mode of minimum OFF time and constant peak inductor current.

3) Time interval of $T_2$-$T_3$: at time point $T_2$, the error amplified signal $V_{EA}$ decreases to be the peak current sense signal, and continues to decrease. So the time length of the current sense signal $V_{CS}$ decreasing to the error amplified signal $V_{EA}$ is prolonged at the set comparator 110. Accordingly, the set input terminal S of the RS flip flop 116 is determined by the set comparison signal; and the OFF time of the main power switch 61 is prolonged. At the reset comparator 113, the current sense signal $V_{CS}$ reaches the second reference voltage $V_{r2}$ in every switching cycle, which would reset the RS flip flop 116 at the reaching point. Accordingly, the LED driver operates at the mode of constant peak inductor current and with a prolonged OFF time of the main power switch.

4) Time interval of $T_3$-$T_4$: at time point $T_3$, the input AC voltage $V_{AC}$ increases to its peak value, and then starts to decrease. So the error amplified signal $V_{EA}$ no longer decreases. As discussed hereinbefore, the second reference voltage $V_{r2}$ has a voltage level higher than twice of the voltage level of the first reference voltage $V_{r1}$, while the peak inductor current is corresponding to the second reference voltage $V_{r2}$, and the average inductor current is corresponding to the first reference voltage $V_{r1}$, so the peak inductor current is higher than twice of the average inductor current. So the inductor current $I_L$ is discontinuous. Accordingly, the LED driver operates at the mode of constant peak inductor current and discontinuous inductor current. However, if the second reference voltage $V_{r2}$ is lower than twice of the first reference voltage $V_{r1}$, the LED driver will operate at the mode of constant peak inductor current and continuous inductor current.

5) Time interval of $T_4$-$T_5$: at time point $T_4$, the peak inductor current starts to decrease with the decrease of the input AC voltage $V_{AC}$, then the current sense signal $V_{CS}$ will not reach the second reference voltage $V_{r2}$; so the reset comparison signal is logical low. Accordingly, the reset input terminal R of the RS flip flop 116 is determined by the maximum ON time signal $T_{max}$. At the error amplifier 109, the error amplified signal $V_{EA}$ starts to increase. So the time length of the current sense signal $V_{CS}$ decreasing to the error amplified signal $V_{EA}$ is shortened. Accordingly, the LED driver operates at the mode of maximum ON time and with a shortened OFF time of the main power switch.

Figure 4:
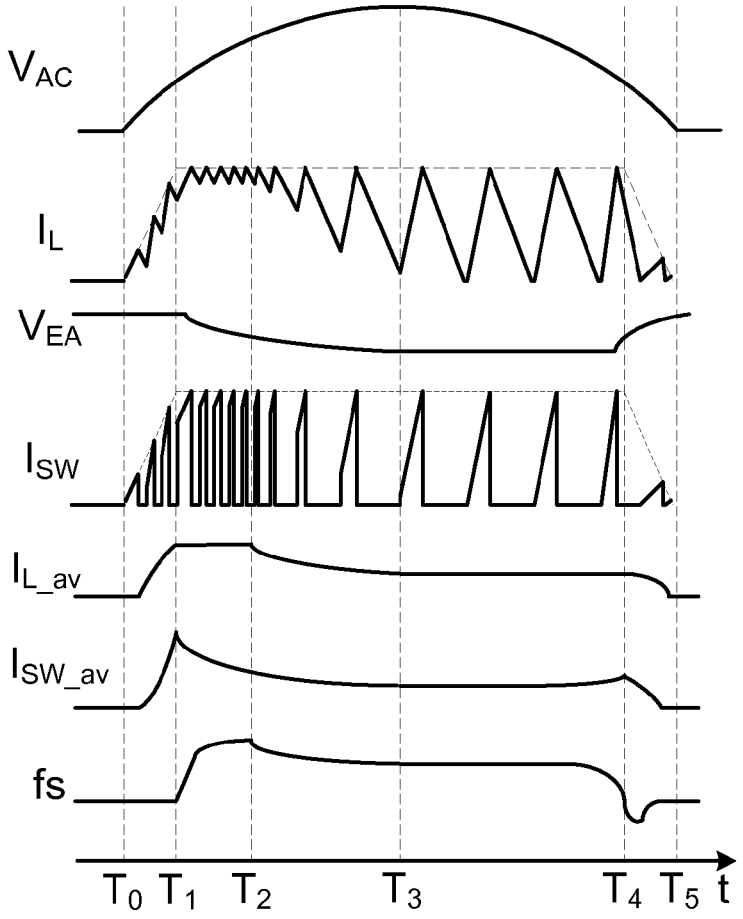
FIG. 4 schematically shows the waveforms of the LED driver 100, 200 and/or 300 when no phase cut is carried to the input AC voltage $V_{AC}$.
Figure 5:
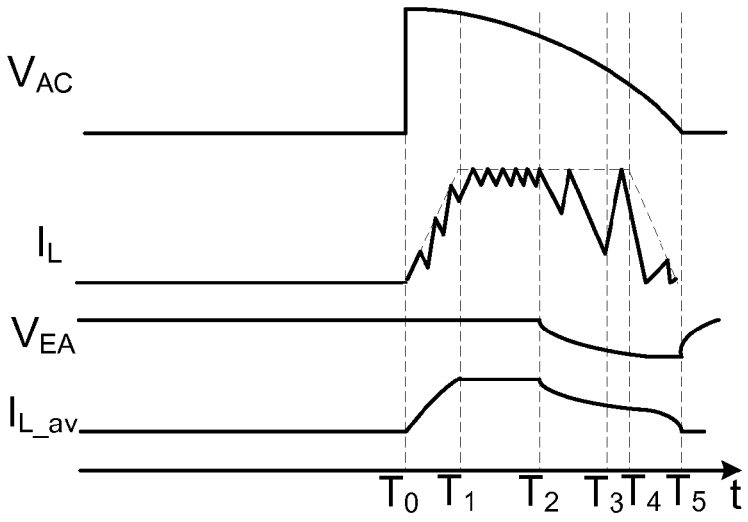
FIG. 5 schematically shows the waveforms of the LED driver 100, 200 and/or 300 when phase cut is carried to the input AC voltage $V_{AC}$.

FIG. 4 schematically shows the waveforms of the LED driver 100, 200 and/or 300 when no phase cut is carried to the input AC voltage $V_{AC}$; and FIG. 5 schematically shows the waveforms of the LED driver 100, 200 and/or 300 when phase cut is carried to the input AC voltage $V_{AC}$.

Figure 6:
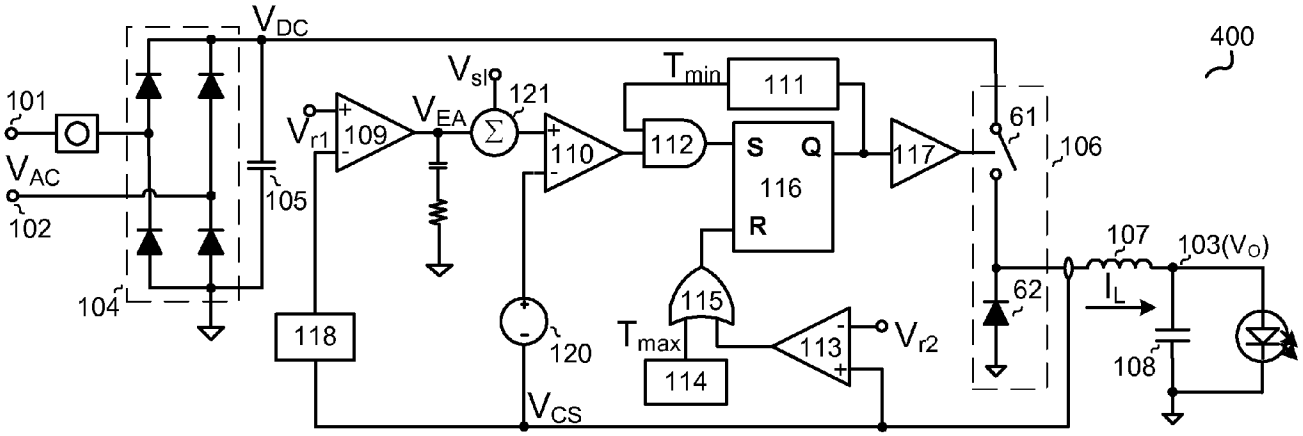
FIG. 6 schematically shows a LED driver 400 in accordance with an embodiment of the present invention.

FIG. 6 schematically shows a LED driver 400 in accordance with an embodiment of the present invention. The LED driver 400 in FIG. 6 is similar with the LED driver 200 in FIG. 2, with a difference that the LED driver 400 in FIG. 6 further comprises: a bias voltage 120, coupled between the current sense signal $V_{CS}$ and the second input terminal of the set comparator 110 to provide a biased current sense signal to the second input terminal of the set comparator 110; and an adder 121, having a first input terminal, a second input terminal and an output terminal, wherein the first input terminal is coupled to the error amplifier 109 to receive the error amplified signal $V_{EA}$, the second input terminal is configured to receive a slope signal Vsl, and wherein the adder 121 generates an operational signal at the output terminal by executing an arithmetic operation on the error amplified signal $V_{EA}$ and the slope signal Vsl. The operational signal is coupled to the first input terminal of the set comparator 110. The other circuit configuration of the LED driver 400 in FIG. 6 is similar to the LED driver 200 in FIG. 2, which will not be illustrated for brevity.

The bias voltage 120 insures the set comparison signal to stably jump between high level and low level when the error amplified signal $V_{EA}$ is zero due to the zero current sense signal under DCM mode.

The operation principle of the LED driver 400 of FIG. 6 is similar to the LED driver 200 in FIG. 2, which will not be illustrated for brevity.

Figure 7:
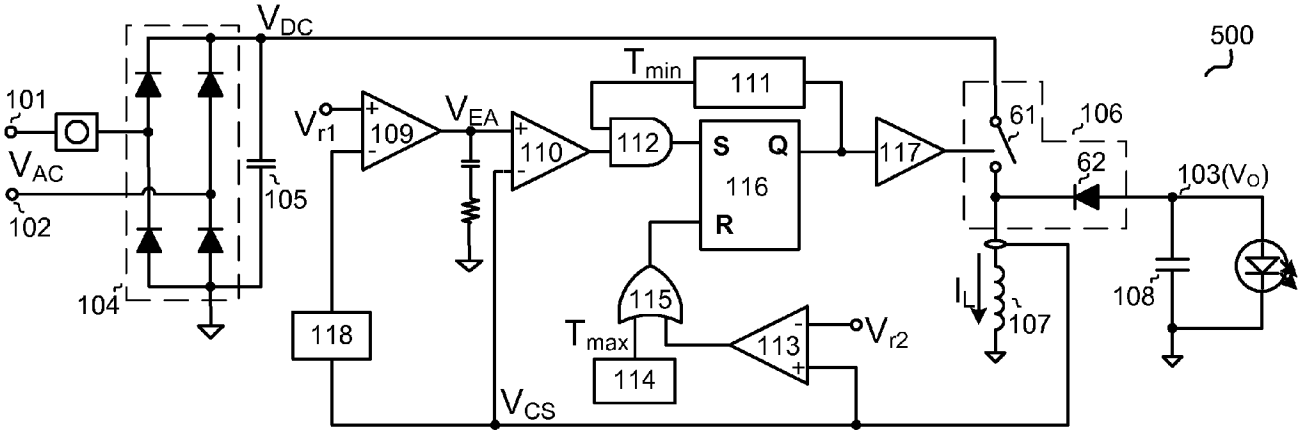
FIG. 7 schematically shows a LED driver 500 in accordance with an embodiment of the present invention.

FIG. 7 schematically shows a LED driver 500 in accordance with an embodiment of the present invention. The LED driver 500 in FIG. 7 is similar with the LED driver 200 in FIG. 2, with a difference that the power stage 106 and the inductor 107 constitute a buck-boost converter in the LED driver 500 in FIG. 7, while the power stage 106 and the inductor 107 constitute a buck converter in the LED driver 200 in FIG. 2. The other circuit configuration of the LED driver 500 in FIG. 7 is similar to the LED driver 200 in FIG. 2, which will not be illustrated for brevity.

As shown in FIG. 4 and FIG. 5, at the initial stage of each delivery cycle of the input AC voltage $V_{AC}$, the average inductor current is relatively high, i.e., the input current of the LED driver is relatively high, which ensures sufficient latching current of the TRIAC dimmer. Thus, several embodiments of the foregoing LED driver need no large RC circuit.

Figure 8:
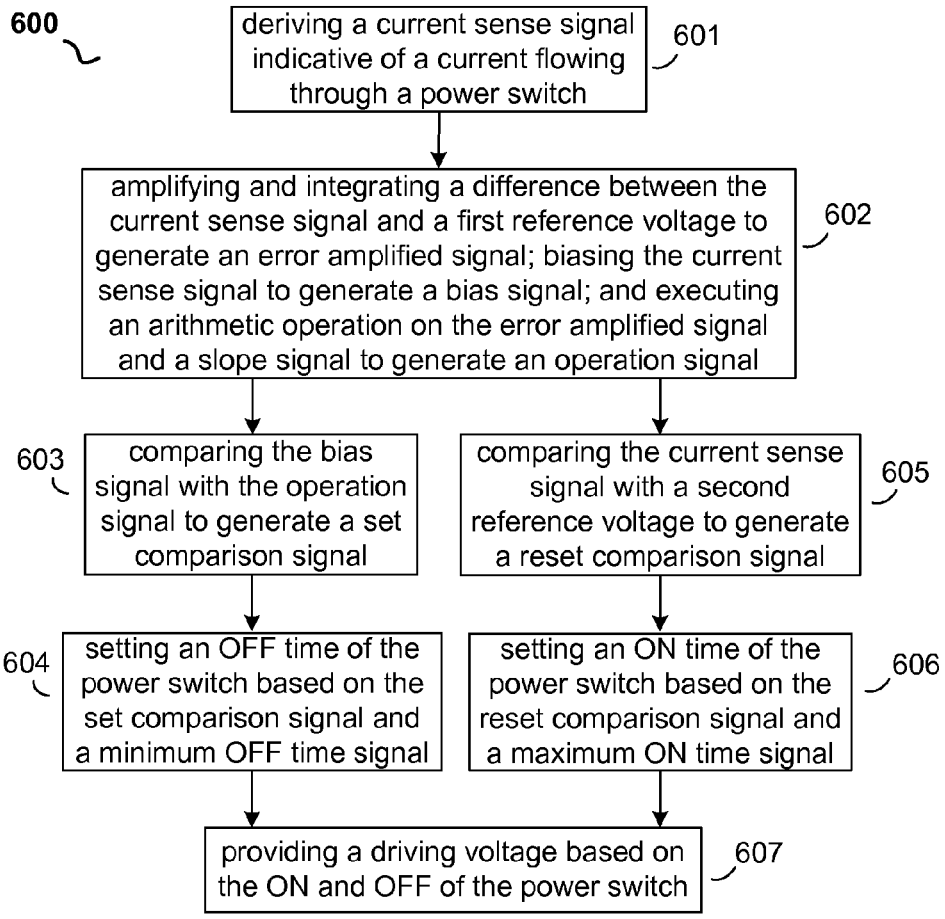
FIG. 8 schematically shows a LED driving method 600 in accordance with an embodiment of the present invention.

FIG. 8 schematically shows a LED driving method 600 in accordance with an embodiment of the present invention. The method comprises:

Step 601, deriving a current sense signal indicative of a current flowing through a power switch.

Step 602, amplifying and integrating a difference between the current sense signal and a first reference voltage to generate an error amplified signal; biasing the current sense signal to generate a bias signal; and executing an arithmetic operation on the error amplified signal and a slope signal to generate an operation signal.

Step 603, comparing the bias signal with the operation signal to generate a set comparison signal.

Step 604, setting an OFF time of the power switch based on the set comparison signal and a minimum OFF time signal.

Step 605, comparing the current sense signal with a second reference voltage to generate a reset comparison signal.

Step 606, setting an ON time of the power switch based on the reset comparison signal and a maximum ON time signal. And Step 607, providing a driving voltage based on the ON and OFF of the power switch.

It is to be understood in these letters patent that the meaning of "A" is coupled to "B" is that either A and B are connected to each other as described below, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

This written description uses examples to disclose the invention, including the best mode, and also to enable a person skilled in the art to make and use the invention. The patentable scope of the invention may include other examples that occur to those skilled in the art.

We claim:

1. A LED driver, comprising:

a first input port and a second input port, configured to receive an input AC voltage;

an output port, configured to provide a driving voltage for the LED;

a power stage, having a main power switch and a freewheel power switch;

an inductor, coupled between the power stage and the output port, wherein the inductor gains energy from the input AC voltage and delivers the energy to the output port when the main power switch is ON and when the freewheel power switch is OFF, and the inductor supplies energy to the output port via the freewheel power switch when the main power switch is OFF;

an output capacitor, coupled between the output port and a reference ground;

an error amplifier, having a first input terminal, a second input terminal and an output terminal, wherein the first input terminal is configured to receive a first reference voltage, the second input terminal is configured to receive a current sense signal indicative of a current flowing through the inductor, and wherein the error amplifier generates an error amplified signal by amplifying and integrating a difference between the first reference voltage and the current sense signal;

a set comparator, having a first input terminal, a second input terminal and an output terminal, wherein the first input terminal is coupled to the error amplifier to receive the error amplified signal, the second input terminal is configured to receive the current sense signal, and wherein based on the error amplified signal and the current sense signal, the set comparator generates a set comparison signal at the output terminal;

a first timer, configured to generate a minimum OFF time signal;

a logical AND circuit, having a first input terminal, a second input terminal and an output terminal, wherein the first input terminal is coupled to the set comparator to receive the set comparison signal, the second input terminal is coupled to the first timer to receive the minimum OFF time signal, and wherein based on the set comparison signal and the minimum OFF time signal, the first logical AND circuit generates a set signal at the output terminal;

a reset comparator, having a first input terminal, a second input terminal and an output terminal, wherein the first input terminal is configured to receive a second reference voltage, the second input terminal is configured to receive the current sense signal, wherein based on the second reference voltage and the current sense signal, the reset comparator generates a reset comparison signal at the output terminal;

a second timer, configured to generate a maximum ON time signal;

a logical OR circuit, having a first input terminal, a second input terminal and an output terminal, wherein the first input terminal is coupled to the reset comparator to receive the reset comparison signal, the second input terminal is coupled to the second timer to receive the maximum ON time signal, wherein based on the reset comparison signal and the maximum ON time signal, the logical OR circuit generates a reset signal at the output terminal;

a RS flip flop, having a set input terminal, a reset input terminal and an output terminal, wherein the set input terminal is coupled to the logical AND circuit to receive the set signal, the reset input terminal is coupled to the logical OR circuit to receive the reset signal, wherein based on the set signal and the reset signal, the RS flip flop generates a control signal at the output terminal; and a driving circuit, coupled to the RS flip flop to receive the control signal to generate a driving signal, to control the operation of the main power switch.

2. The LED driver of claim 1, further comprising:

an average circuit, configured to receive the current sense signal to generate an average signal to the second input terminal of the error amplifier.

3. The LED driver of claim 1, further comprising:

a leading edge blanking circuit, configured to receive and to blank the current sense signal, and to deliver the blanked current sense signal to the second input terminal of the reset comparator.

4. The LED driver of claim 1, further comprising:

a bias voltage, coupled between the current sense signal and the second input terminal of the set comparator to provide a biased current sense signal to the second input terminal of the set comparator; and an adder, having a first input terminal, a second input terminal and an output terminal, wherein the first input terminal is coupled to the error amplifier to receive the error amplified signal, the second input terminal is configured to receive a slope signal, and wherein the adder generates an operational signal at the output terminal by executing an arithmetic operation on the error amplified signal and the slope signal.

5. The LED driver of claim 1, further comprising:

a TRIAC dimmer, coupled between the first input port and the rectifier.

6. The LED driver of claim 1, wherein the first timer starts to time in response to a falling edge of the control signal, to generate the minimum OFF time signal.

7. A control circuit used for a LED driver, the LED driver including a main power switch, a freewheel power switch and an inductor, the control circuit comprising:

an error amplifier, configured to receive a first reference voltage and a current sense signal indicative of a current flowing through the inductor, to generate an error amplified signal;

a set comparator, configured to receive the error amplified signal and the current sense signal, to generate a set comparison signal;

a first timer, configured to generate a minimum OFF time signal;

a logical AND circuit, configured to receive the set comparison signal and the minimum OFF time signal, to generate a set signal;

a reset comparator, configured to receive a second reference voltage and the current sense signal, to generate a reset comparison signal;

a second timer, configured to generate a maximum ON time signal;

a logical OR circuit, configured to receive the reset comparison signal and the maximum ON time signal, to generate a reset signal;

a RS flip flop, configured to receive the set signal and the reset signal, to generate a control signal; and a driving circuit, configured to receive the control signal to generate a driving signal, to control the operation of the main power switch.

8. The LED driver of claim 1, further comprising:

an average circuit, configured to receive the current sense signal to generate an average signal to the error amplifier.

9. The control circuit of claim 7, further comprising:

a leading edge blanking circuit, configured to receive and to blank the current sense signal, and to deliver the blanked current sense signal to the reset comparator.

10. The control circuit of claim 7, further comprising:

a bias voltage, coupled between the current sense signal and the set comparator to provide a biased current sense signal to the set comparator; and an adder, configured to receive the error amplified signal and a slope signal, to generate an operational signal to the set comparator.

11. The control circuit of claim 7, wherein the first timer starts to time in response to a falling edge of the control signal, to generate the minimum OFF time signal.

12. The control circuit of claim 7, wherein the LED driver further comprises a TRIAC dimmer.

13. A LED driving method, comprising:

deriving a current sense signal indicative of a current flowing through a power switch;

amplifying and integrating a difference between the current sense signal and a first reference voltage to generate an error amplified signal;

biasing the current sense signal to generate a bias signal;

executing an arithmetic operation on the error amplified signal and a slope signal to generate an operation signal;

comparing the bias signal with the operation signal to generate a set comparison signal;

setting an OFF time of the power switch based on the set comparison signal and a minimum OFF time signal;

comparing the current sense signal with a second reference voltage to generate a reset comparison signal;

setting an ON time of the power switch based on the reset comparison signal and a maximum ON time signal; and providing a driving voltage based on the ON and OFF of the power switch.

14. The LED driving method of claim 13, further comprising:

averaging the current sense signal to generate an average signal;

wherein the error amplified signal is generated by amplifying and integrating a difference between the averaged signal and the first reference voltage.

15. The LED driving method of claim 13, further comprising:

blanking the current sense signal to generate a blanked current sense signal;

wherein the reset comparison signal is generated by comparing the blanked current sense signal with the second reference voltage.

* * * * *